US005573328A

United States Patent [19]

Hwang

[11] Patent Number: 5,573,328

[45] **Date of Patent: * Nov. 12, 1996**

[54] HOUSE NUMBER LIGHT BOX

[76] Inventor: Steven Hwang, 4F., No. 6-6, Alley 11, Lane 147, Hsin Yi Road, Sec. 3, Taipei, Taiwan

[ * ] Notice: The term of this patent shall not extend beyond the expiration date of Pat. No. 5,408,773.

[21] Appl. No.: 407,361

[22] Filed: Mar. 30, 1995

[51] Int. Cl.[6] ..... F21L 7/00

[52] U.S. Cl. ..... 362/183; 362/32; 362/81; 40/547

[58] Field of Search ..... 362/183, 32, 812; 40/547, 561, 568

[56] References Cited

U.S. PATENT DOCUMENTS

| | | | |
|---|---|---|---|
| 4,279,089 | 7/1981 | Murakami | 40/547 |
| 4,765,080 | 8/1988 | Conti | 40/576 |
| 4,901,461 | 2/1990 | Edwards et al. | 40/575 |
| 4,903,172 | 2/1990 | Schöniger et al. | 362/183 |
| 4,947,300 | 8/1990 | Wen | 362/183 |
| 5,252,893 | 10/1993 | Chacham et al. | 362/183 |
| 5,408,773 | 4/1995 | Hwang | 40/547 |

*Primary Examiner*—Denise L. Gromada
*Assistant Examiner*—Alfred Basichas
*Attorney, Agent, or Firm*—Bacon & Thomas

[57] ABSTRACT

A house number light box including a housing covered with a transparent covering to hold a house number panel and a control circuit on the inside and a solar cell on the outside, the control circuit consisting of a battery, a switch circuit, an oscillatory circuit, and a light source, the house number panel having a front side bearing a house number, a plurality of through holes arranged along the border of the house number, a back side fixed with a holder to hold a number of optical fiber tubes, each optical fiber tube having one end fastened to one through hole on the house number panel and an opposite end abutted to the light source, wherein the solar cell converts the radiating energy of the sun into electric energy to charge the battery during the day; the battery provides the necessary working voltage to the control circuit, causing it to turn on the light source during the night.

2 Claims, 3 Drawing Sheets

HOUSE NUMBER LIGHT BOX

BACKGROUND OF THE INVENTION

The present invention relates to a house number light box which uses optical fiber tubes to transmit light from a light source to through holes on the border of the house number on a replaceable house number panel, a battery to provide power supply to the light source during the night, and a solar cell to convert the radiating energy of the sun into electric energy for charging the battery during the day.

Regular house (residence) number plates which are to be mounted on the outside of a house to show the the number of the house must be illuminated so that the house number can be seen by visitors, postmen, etc. at night or during bad weather. However, because regular outdoor lamps are turned on the whole night and then turned off manually in the morning, they consume much power supply during the operation.

Furthermore, various house number light boxes have been developed and used by families. These house number light boxes commonly use light emitting elements arranged into a layout showing the desired house number. As many light emitting elements are used, the maintenance work can be complicated, and much power supply is consumed.

SUMMARY OF THE INVENTION

The present invention has been accomplished to provide a house number light box which eliminates the aforesaid drawbacks. According to one aspect of the present invention, the house number light box comprises a housing covered with a transparent covering to hold a house number panel and a control circuit on the inside and a solar cell on the outside. The control circuit is comprised of a battery, a switch circuit, an oscillatory circuit, and a light source. The house number panel comprises a front side bearing a house number, a plurality of through holes arranged along the border of the house number, and a back side fixed with a holder to hold a number of optical fiber tubes. Each optical fiber tube has one end fastened to one through hole on the house number panel and an opposite end abutted to the light source for transmitting the light of the light source to the house number. The solar cell converts the radiating energy of the sun into electric energy to charge the battery during the day. The battery provides the necessary working voltage to the control circuit, causing it to turn on the light source during the night.

According to another aspect of the present invention, the light source is mounted on the holder on the back side of the house number panel and abutted to the optical fiber tubes. The house number panel is detachably mounted within a front mounting groove inside a transparent covering on the housing. Therefore, the house number panel is replaceable as desired.

DETAILED DESCRIPTION OF THE PREFERRED EMBODIMENT

Figure 1:
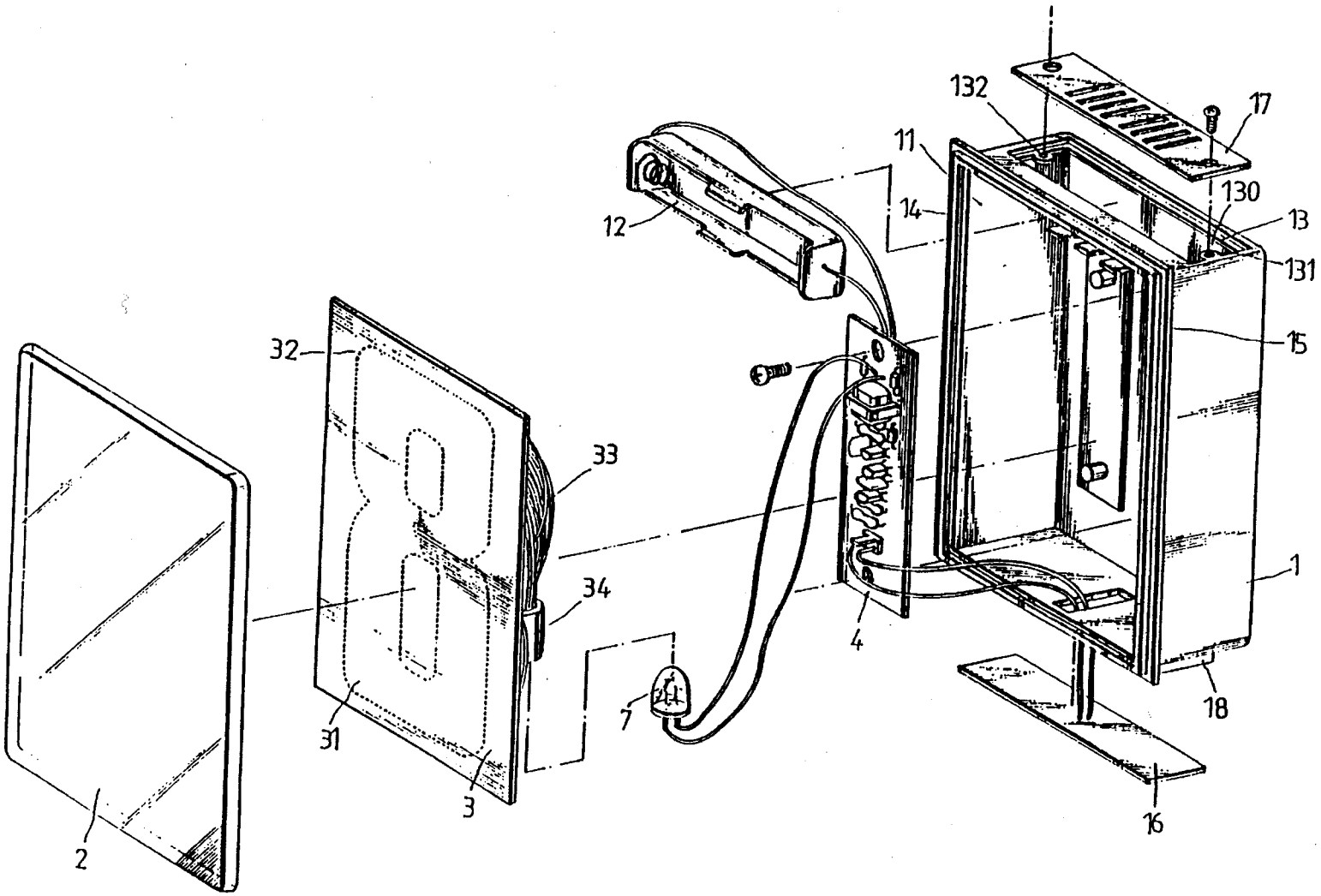
FIG. 1 is an exploded view of a house number light box according to the present invention.

Referring to FIG. 1, the house number light box of the present invention comprises a housing 1, a house number panel 3, a control circuit board 4, and a light source 7. The housing 1 comprises a receiving chamber 11, which receives the control circuit board 4, a battery box 12 mounted inside the receiving chamber 11 at one side and electrically connected to the control circuit board 4 by electric wires, on top of the battery box 12, the receiving chamber 11 has an opening 130, a mounting groove 13 surrounding the opening 130, two horizontal lugs 131 respectively extended from two opposite sides of the mounting groove 13 and projecting into the opening 130, each horizontal lug 131 defining a mounting hole 132, a lid 17 fitted into the mounting groove 13 and fastened to the mounting holes 132 on the horizontal lugs 131 to cover the opening 130, on the opposite side of the opening 130 a recess 18 disposed on the outside of the chamber 11, a solar cell 16 mounted within the recess 18 and electrically connected to the control circuit board 4 by electric wires, a house number panel mounting groove 14 around the border of the front open side thereof, which receives the house number panel 3, a mounting flange 15 around the house number panel mounting groove 14, and a transparent covering 2 fastened to the mounting flange 15 and covered over the house number panel 3. The house number panel 3 may have a white color printed with a house number 31 of red color, and has a plurality of small through holes 32 arranged along the border of the house number 31. The back side of the house number panel 3 is mounted with a holder 34, which holds a bunch of optical fiber tubes 33. Each optical fiber tube 33 has one end abutted to the light source 7 and an opposite end fastened to one through hole 32 on the house number panel 3.

Figure 2:
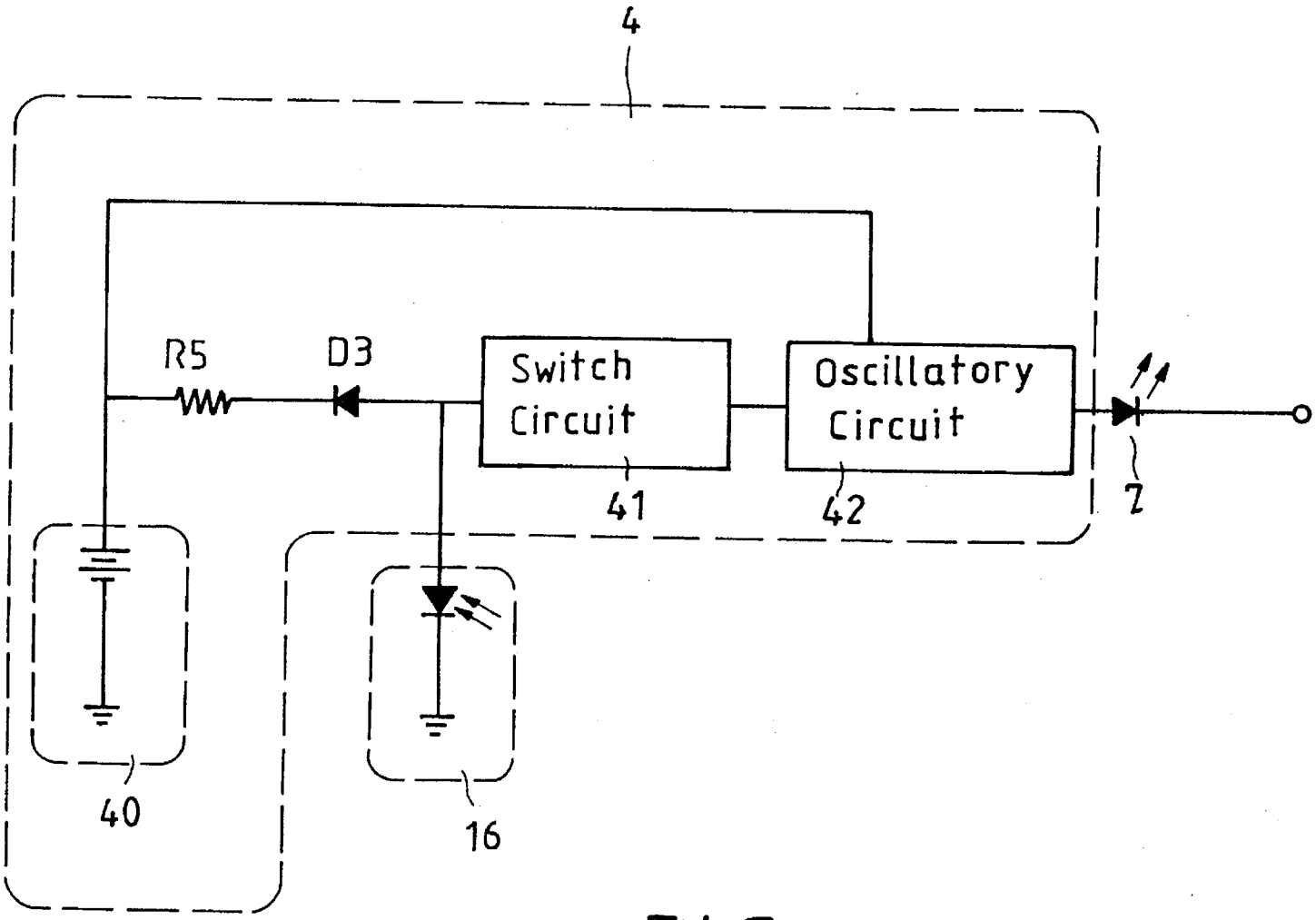
FIG. 2 is a circuit block diagram of the control circuit board for the house number light box shown in FIG. 1.
Figure 3:
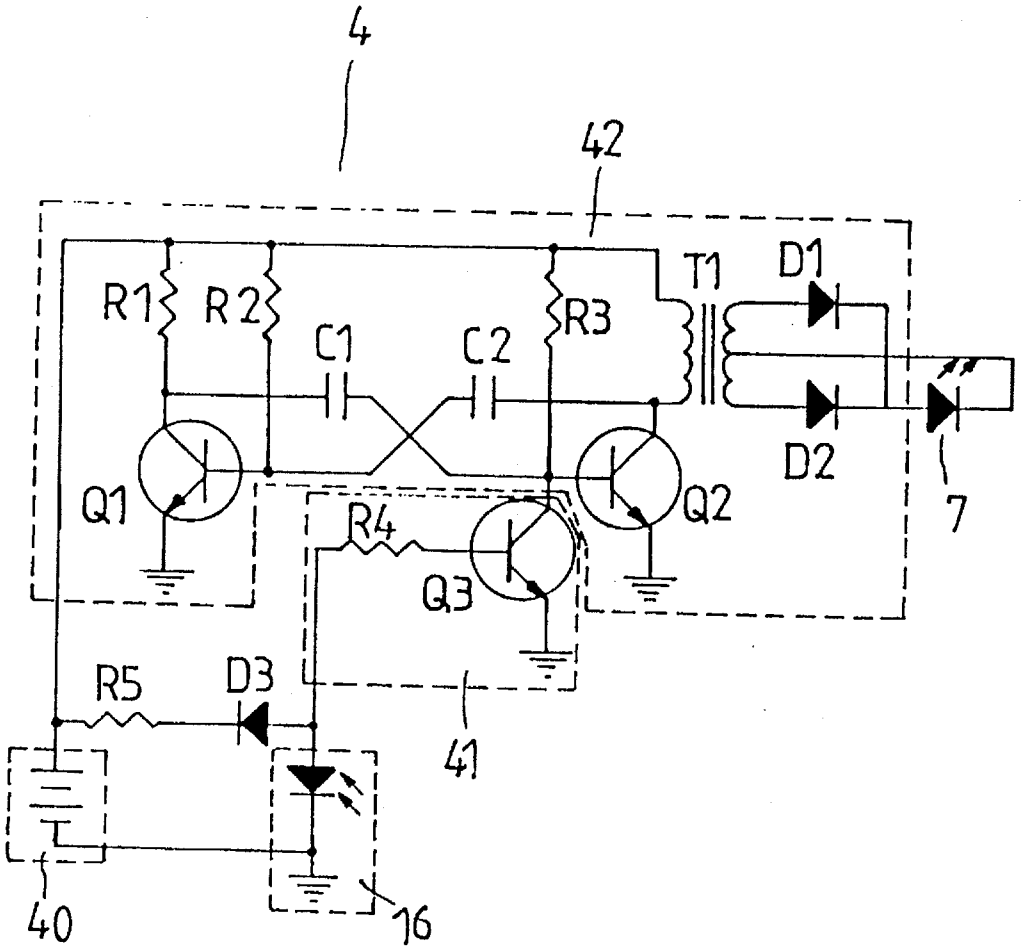
FIG. 3 is a circuit diagram of the control circuit board of FIG. 2.

Referring to FIGS. 2 and 3, the control circuit board 4 is comprised of a storage battery 40, a switch circuit 41, and an oscillatory circuit 42. The switch circuit 41 is comprised of a transistor Q3 and a resistor R4. The input terminal of the switch circuit 41 is connected to the solar cell 16 and the battery 40 through a diode D3 and a current-limiting resistor R5. The output terminal of the switch circuit 41 is connected to the input terminal of the oscillatory circuit 42. The oscillatory circuit 42 is comprised of transistors Q1 and Q2, resistors R1, R2 and R3, capacitors C1 and C2, a transformer T1, and rectifying diodes D1 and D2. The necessary working voltage to the oscillatory circuit 42 is obtained from the battery 40. The output terminal of the oscillatory circuit 42 is connected to the light source 7. The solar cell 16 collects the radiating energy of the sun and converts it into electric energy to turn on the switch circuit 41, causing the oscillatory circuit 42 maintained at the open circuit status, therefore the electric energy of the solar cell 16 is transmitted through the diode D3 and the resistor R5 to charge the battery 40.

When the solar cell 16 receives no light from the sun, the switch circuit 41 is turned off. Under this condition, the battery 40 provides the necessary working voltage to the oscillatory circuit 42, causing the oscillatory circuit 42 to oscillate and to boost the transformer T1. The voltage from the transformer T1 is then rectified by the rectifying diodes D1 and D2 and then transmitted to the light source 7, causing the light source 7 to be turned on. Light rays from the light source 7 are then transmitted through the optical fiber tubes 33 to illuminate the house number panel 5.

While only one embodiment of the present invention has been shown and described, it will be understood that various modifications and changes could be made without departing from the spirit and scope of the invention.

What is claimed is:

1. A house number light box comprising:

a housing having an opening on one side, a recess at an opposite side, and a transparent front covering; a battery box located inside of said housing beneath said opening; a solar cell located within said recess;

a control circuit mounted within said housing, said control circuit comprising a battery mounted inside said battery box, a switch circuit, an oscillatory circuit, and a light source, said switch circuit having an input terminal connected to said solar cell and connected to said battery through a diode and a current limiting resistor, and an output terminal connected to said oscillatory circuit, said oscillatory circuit having an input terminal connected to said switch circuit and an output terminal connected to said light source; and a house number panel mounted within said housing behind said transparent front covering, said house number panel comprising a front side bearing a house number, a plurality of through holes arranged along a border of said house number, and a back side; a plurality of optical fiber tubes, each having one end abutted to said light source and an opposite end fastened to said house number panel in alignment with one of said through holes on said house number panel.

2. The house number light box of claim 1 wherein said battery is a rechargeable battery.

* * * * *